US006427769B2

(12) United States Patent
Horie et al.

(10) Patent No.: US 6,427,769 B2
(45) Date of Patent: Aug. 6, 2002

(54) HEAT EXCHANGER HAVING TUBE JOINED TO CORE PLATE AND METHOD OF MANUFACTURING THE SAME

(75) Inventors: Kouji Horie, Toyota; Seiichi Kato, Toyoake; Hisashi Nakashima, Kariya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/326,223

(22) Filed: Jun. 3, 1999

(30) Foreign Application Priority Data

Jun. 4, 1998 (JP) ..... 10-156042

(51) Int. Cl.[7] ..... F28F 9/04; F28F 9/02; F28F 13/18

(52) U.S. Cl. ..... 165/178; 165/133; 165/173; 29/890.043

(58) Field of Search ..... 165/178, 173, 165/175, 153, 133, 79; 29/890.038, 890.043

(56) References Cited

U.S. PATENT DOCUMENTS

| | | | | |
|---|---|---|---|---|
| 3,619,255 A | * | 11/1971 | Lengnick | 523/414 |
| 3,769,050 A | * | 10/1973 | Terry et al. | 106/635 |
| 3,888,815 A | * | 6/1975 | Bessmer et al. | 524/703 |
| 3,909,387 A | * | 9/1975 | Kolic et al. | 204/206 |
| 3,959,063 A | * | 5/1976 | Hawthorne | 156/325 |
| 4,028,205 A | * | 6/1977 | Dorsey, Jr. | 204/488 |
| 4,138,526 A | * | 2/1979 | Borresen et al. | 428/419 |
| 4,465,738 A | | 8/1984 | Chang | |
| 4,546,822 A | * | 10/1985 | Tamura | 165/149 |
| 4,555,294 A | * | 11/1985 | Adams et al. | 156/309.6 |
| 4,582,726 A | * | 4/1986 | Shuey et al. | 427/208.8 |
| 5,001,173 A | * | 3/1991 | Anderson | 428/429 |
| 5,260,357 A | * | 11/1993 | Sachdeva | 523/406 |
| 5,326,594 A | * | 7/1994 | Sabata et al. | 427/327 |
| 5,575,330 A | * | 11/1996 | Hoefken | 165/170 |
| 5,580,915 A | * | 12/1996 | Lin | 524/267 |

FOREIGN PATENT DOCUMENTS

| | | |
|---|---|---|
| EP | 0845 650 A2 | 6/1998 |
| FR | 2 506 864 | 12/1982 |
| JP | U-61-181986 | 11/1986 |
| JP | A-1-297482 | 11/1989 |
| JP | A1297482 | * 11/1989 |

OTHER PUBLICATIONS

Derwent Publications Ltd, AN 1994–018634, XP–002129218, & JP 05–320585, Dec. 3, 1993 Abstract.

* cited by examiner

*Primary Examiner*—Henry Bennett
*Assistant Examiner*—Tho V Duong
(74) *Attorney, Agent, or Firm*—Harness, Dickey & Pierce, PLC

(57) ABSTRACT

A heat exchanger has a tank for accommodating a heat medium therein and a tube connected to the tank through a core plate. Specifically, an end portion of the tube is inserted into a connection hole of the core plate and is mechanically joined thereto. A joined portion of the tube and the core plate is covered with adhesive through a wettability improving film for improving wettability of the adhesive to the joined portion. As a result, a sealing property between the tube and the core plate is easily and stably improved by the adhesive.

21 Claims, 4 Drawing Sheets

HEAT EXCHANGER HAVING TUBE JOINED TO CORE PLATE AND METHOD OF MANUFACTURING THE SAME

CROSS REFERENCE TO RELATED APPLICATION

This application is based upon and claims the benefit of Japanese Patent Application No. 10-156042, filed on Jun. 4, 1998, the contents of which are incorporated herein by reference.

BACKGROUND OF THE INVENTION

1. Field of the Invention

This invention relates to a heat exchanger and a method of manufacturing the same with adhesive for securing a sealing property between a tube and a tank.

2. Description of the Related Art

A heat exchanger typically has tanks for accommodating heat medium therein, and plural tubes coupled with radiation fins and connected to the tanks through core plates. Specifically, end portions of the tubes are inserted into connection holes provided in the core plates, and joined thereto. After that, the core plates are attached to the tanks. The core plates and the tubes must secure a sufficient sealing property at joining portions therebetween for preventing leakage of the heat medium therefrom. Conventionally, the core plates and the tubes have been brazed to one another with the sufficient sealing property.

Recently, methods other than brazing for joining the core plates and the tubes have been proposed to rationalize the manufacturing process. For instance, mechanical processing such as crimping is carried out to produce pushing force between outer circumference surfaces of the tubes and the connection holes of the core plates so that the tubes are joined to the core plates by the pushing force. The mechanical joining method described above, however, easily produce minute clearances at the joining portions to lessen the sealing property. Therefore, this method requires a countermeasure for improving the sealing property.

To solve this problem, JP-U-61-18986 proposes a method in which sealing agent such as adhesive is applied to the joining portions after the mechanical joining is carried out. However, the sealing property cannot be sufficiently improved only by applying the sealing agent. It was confirmed by an immersion test that the joined core plates and the tubes dipped into an engine cooling water were separated from one another in a short period of time.

SUMMARY OF THE INVENTION

The present invention has been made in view of the above problem. An object of the present invention is to provide a heat exchanger having a core plate and a tube joined to each other with a sufficient sealing property and a method of stably and easily manufacturing the same.

According to the present invention, a heat exchanger has a tank for accommodating a heat medium therein, a core plate fixed to the tank and having a connection hole, and a tube having an end portion fixedly inserted into the connection hole of the core plate. The tube and the core plate are made of one of aluminum and aluminum alloy, and are mechanically joined to each other at a joined portion thereof. Further, an adhesive is disposed on a specific region of the joined portion through a wettability improving film interposed therebetween for improving a wettability of the adhesive to the specific region.

The wettability improving film makes the adhesive securely adhered to the joined portion therethrough. Specifically, because the wettability improving film has a good wettability to the adhesive, the adhesive can fill minute concave portions of the specific region even when surface roughness of the specific region is large. As a result, the sealing property between the tube and the core plate is improved.

The tube and the core plate can be mechanically joined to each other with the specific region covered with the wettability improving film. The wettability improving film may be formed before or after the tube and the core plate are joined to each other. After that, the adhesive is formed on the specific region through the wettability improving film.

The wettability improving film may be formed by jetting out a solution onto the specific region, and be formed by dipping the specific region into a solution. Accordingly, the heat exchanger can be easily and stably manufactured with a high sealing property.

BRIEF DESCRIPTION OF THE DRAWINGS

Other objects and features of the present invention will become more readily apparent from a better understanding of the preferred embodiments described below with reference to the following drawings.

DETAILED DESCRIPTION OF THE PREFERRED EMBODIMENTS

Figure 1:
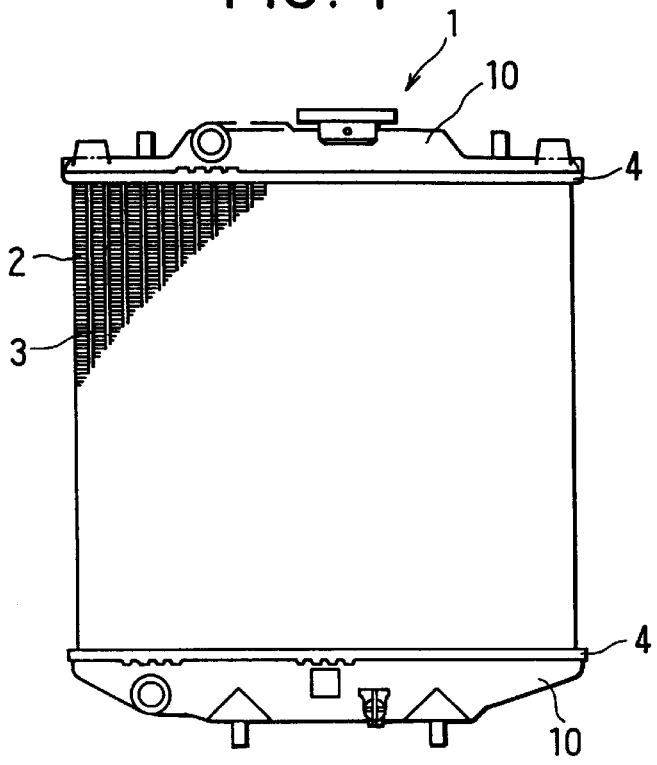
FIG. 1 is a front view showing a heat exchanger of a preferred embodiment according to the present invention.
Figure 2A:
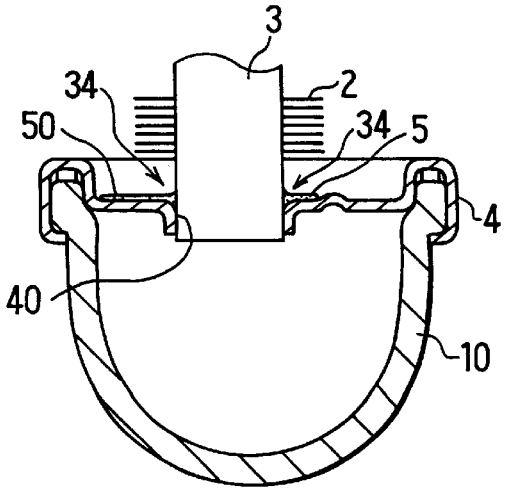
FIG. 2A is a cross-sectional view showing a joined portion of a tube and a core plate in the heat exchanger.
Figure 2B:
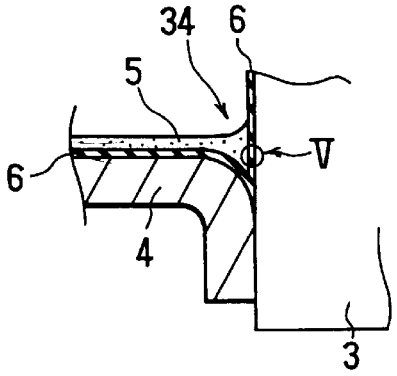
FIG. 2B is an enlarged view showing the joined portion of FIG. 2A.

A heat exchanger in a preferred embodiment of the present invention will be explained referring to FIGS. 1 to 4. As shown in FIG. 1, the heat exchanger 1 in the present embodiment is used as an automotive radiator, and has tanks 10 for accommodating heat medium therein, plural tubes 3 coupled with radiation fins 2, and core plates 4 for connecting the tubes 3 to the tanks 10. End portions of the tubes 3 are inserted into connection holes 40 provided in the core plates and are joined thereto. As shown in FIGS. 2A and 2B, the tubes 3 and the core plates 4 are joined to one another by mechanical processing with adhesive 5 interposes therebetween for maintaining a sealing property. The adhesive 5 is applied to surfaces of the tubes 3 and the core plates 4 on which a wettability improvement film 6 for improving the wettability of the adhesive 5 is formed.

When manufacturing the heat exchanger 1, first, the tubes 3 are inserted to the corresponding connection holes 40 of the core plates 4. In this state, each inside diameter of the tubes 3 is enlarged from inside thereof using a mandrel or the like having a diameter slightly larger than that of the tubes 3. Accordingly, the tubes 3 are pushed against the connection holes 40 with force, thereby being mechanically joined to the core plates 4.

Next, in the present embodiment, the wettability improvement film 6 is formed after the tubes 3 and the core plates 4 are joined to one another as described above. The formation of the wettability improvement film 6 is carried out by applying a solution containing 3% to 5% treatment agent including a silicate (Trade Name : GILDAON produced by Central Chemical Co.), like a shower, onto a specific film formation region where the adhesive 5 is to be formed.

Figure 3:
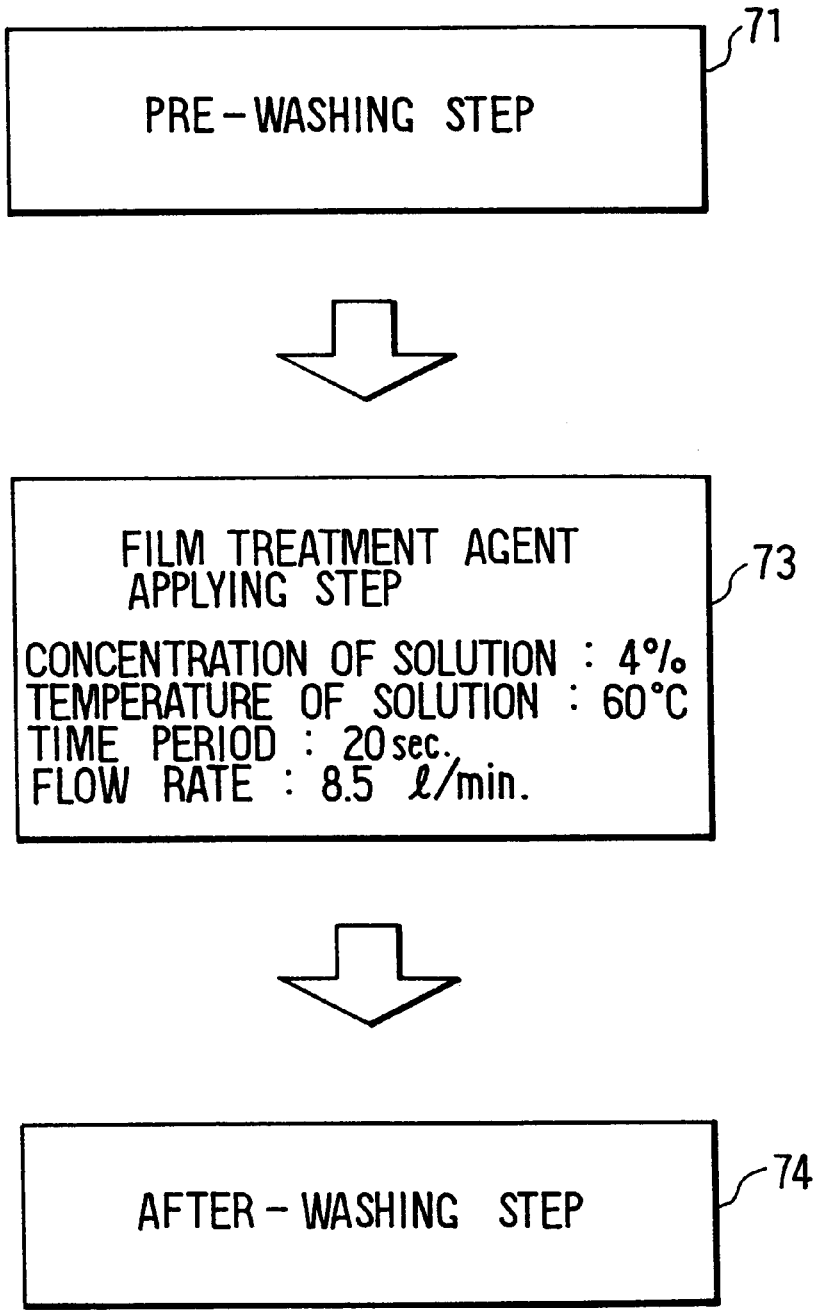
FIG. 3 is a flow chart showing a process of forming a wettability improving film.
Figure 4:
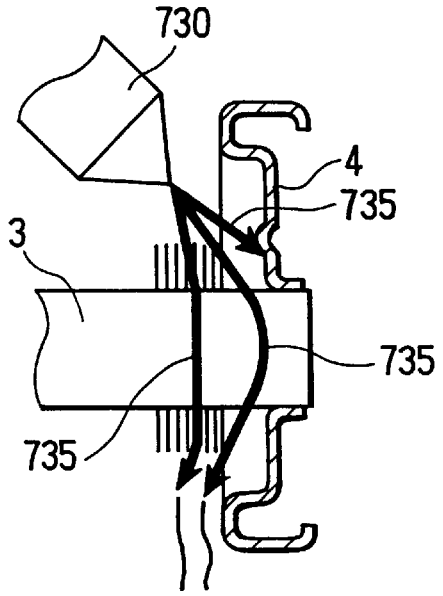
FIG. 4 is an explanatory view showing a state where solution for forming the wettability improving film is jetted out.

Specifically, as shown in FIG. 3, after pre-washing step 71 is carried out on the tubes 3 and the core plates 4, film treatment agent applying step 73 and after-washing step 74 are successively carried out. At the pre-washing step 71, hot water of 60° C. is jetted out from a shower for approximately 20 seconds to wash the joined tubes 3 and the core plates 4. At the film treatment agent applying step 73, the solution including GILDAON of 30 g–50 g/liter in concentration and 60° C. in temperature is applied onto the film formation region for approximately 20 seconds. At this step, as shown in FIG. 4, the solution 735 jetted out from an injection nozzle 730 like a shower is selectively sprayed onto the film formation region in proximity to the joined portion.

AT the film treatment agent applying step 73, because the solution includes the silicate system film material and the tubes 3 and the core plates 4 are made of aluminum alloy, when the solution is applied to the tubes 3 and the core plates 4, the wettability improvement film 6 can be formed with an extremely thin thickness during a short period of time (approximately 10 seconds) by chemical reactions on the tubes 3 and the core plates 4. Then, the washing using hot water is carried out at the after-washing step 74 substantially in the same manner as that at the pre-washing step 71 to remove extra treatment agent and the like.

Subsequently, the adhesive 5 is applied to the joined portions between the tubes 3 and the core plates 4. In the present embodiment, silicone system adhesive is used as the adhesive 5. The application of the adhesive 5 is carried out by a dispenser or the like from a side of the core plates 4 to seal the peripheries of the tubes 3. After that, the tanks 10 are attached to the core plates 4, thereby forming the heat exchanger 1 shown in FIG. 1.

Next, effects of the present embodiment will be explained. In the heat exchanger 1, the wettability improvement film 6 is formed before applying the adhesive 5 with large wettability to the adhesive 5. Therefore, the adhesive 5 closely adheres to the surfaces of the tubes 3 and the core plates 4 through the wettability improvement film 6 even when the surface roughnesses of the tubes 3 and the core plates 4 are large. Since the adhesive 5 can invade even into minute clearances surrounded by the wettability improvement film 6 due to the large wettability thereof, as shown in FIG. 2B, the adhesive 5 can fill the joined portions 34 without forming empty spaces. As a result, the sealing property at the joined portions 34 is improved by the adhesive 5.

Further, the tubes 3 and the core plates 4 are mechanically joined to each other to produce mechanical stress which makes the joining strength therebetween large. Therefore, it is sufficient for the adhesive 5 to have only a function for improving the sealing property. The silicone system adhesive can be used to exhibit the adhesive property. As a result, according to the present invention, the sealing property between the core plates 4 and the tubes 3 can be provided without performing brazing thereof.

Incidentally, there is a case where MgO contained in aluminum (Al) as an additive is deposited on the Al surface to inhibit the adhesiveness between the adhesive and the Al surface. Generally, alkaline metals work as described above, and MgO is a basic oxide having a large base strength. In the present embodiment, however, because the Al surface is covered with the silicate film or the like, the adhesive can maintain its adhesiveness to the Al surface.

The sealing property between the tubes 3 and the core plates 4 in the heat exchanger 1 was experimentally evaluated in comparison with a comparative sample C1 in which the silicone system adhesive 5 described above was coated onto the joined portions 34 without interposing the wettability improvement film 6 therebetween. The other features of the comparative sample C1 were substantially the same as those of the heat exchanger 1 (herebelow, referred to as the present invention sample E1).

Figure 6:
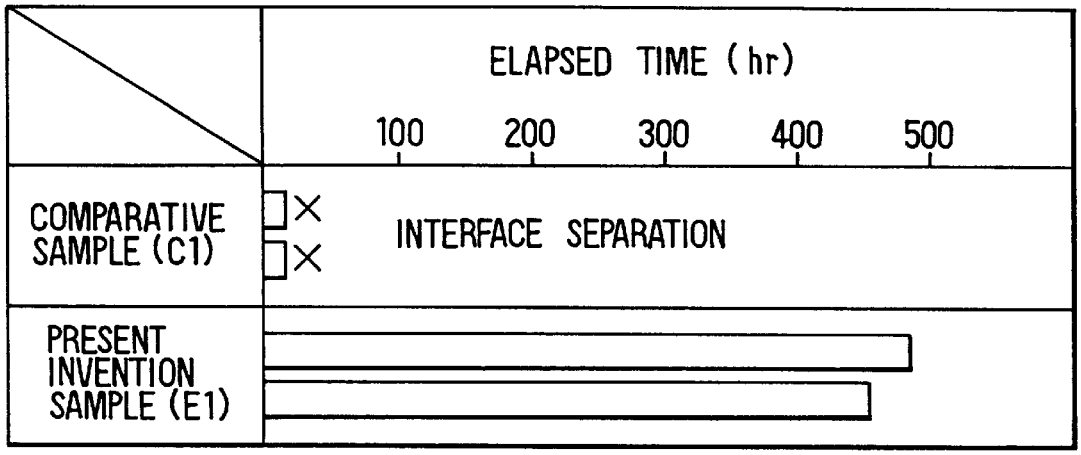
FIG. 6 is a chart specifically showing an effect of the adhesiveness (durability) of the adhesives when the wettability improving film is provided and is not provided.

Specifically, two present invention samples E1 and two comparative samples C1 filled with LLC were prepared, and put within a thermostatic chamber kept at 130° C. The results are shown in FIG. 6, in which a horizontal axis indicates elapsed time (Hr) of the test. According to the figure, in the comparative examples C1 without having the wettability improvement film, the adhesives were separated from the joined portions 34 at extremely short time periods. As opposed to this, in the present invention samples E1 having the wettability improvement film, the adhesives were not separated from the joined portions 34 even after 400 Hr was elapsed. As a result, it was confirmed that the present invention sample (heat exchanger 1) could exhibit excellent durability (sealing property) by providing the wettability improvement film 6.

Figure 5A:
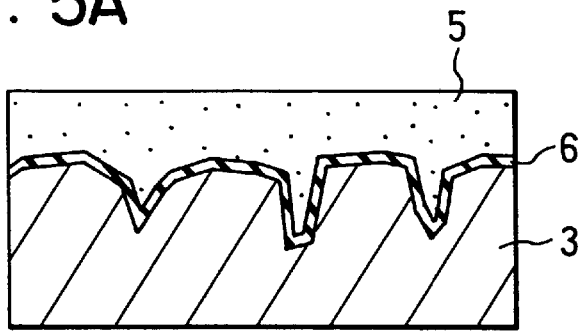
FIGS. 5A and 5B are explanatory views showing a difference of adhesive states in two cases where the wettability improving film is provided and is not provided.
Figure 5B:
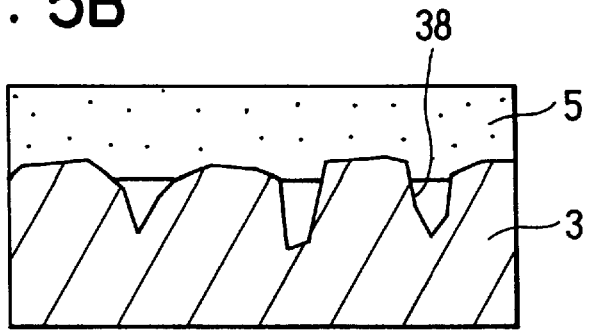

Also, the states of the adhesives 5 of the present invention sample E1 and the comparative example sample C1 were observed at interface portions between the tube 3 and the adhesives 5, one of which is indicated by an arrow V in FIG. 2B as an example. The results are schematically shown in FIGS. 5A and 5B. FIG. 5A shows the state of the present invention sample E1, while FIG. 5B shows the state of the comparative sample C1. As shown in FIG. 5A, in the present invention sample E1, the wettability improvement film 6 was formed along the surface irregularity of the tube 3, and the adhesive 5 was adhered thereon entirely along the shape while filling minute concave portions of the tube 3. As opposed to this, as shown in FIG. 5B, in the comparative sample C1, the adhesive did not fill concave portions 38 provided by the surface irregularity of the tube 3. This implies insufficient adhesiveness capable of reducing the durability. It is presumed that the insufficient adhesiveness of the comparative sample C1 is caused by the fact that the wettability improvement film 6 is not formed.

The effect of the wettability improvement film 6 was further studied using three samples, one of which had the silicate system film as the wettability improvement film 6 as described above, another one of which had an organic film formed by a primer treatment that is conventionally carried out as a coating surface treatment, and another one of which did not have the wettability improvement film 6. The silicone system adhesive was used as the adhesive 5 as well as in the present embodiment. The comparison was carried out by measuring adhesive strengths (MPa). Specifically, two test pieces made of aluminum alloy were adhered to one another with an adhesive thickness of 2 mm at an adhesive area of 10 mm×25 mm. Then, the strength was measured by a tensile tester such as an auto graph with 5 mm/min. in an elastic stress rate.

Figure 7:
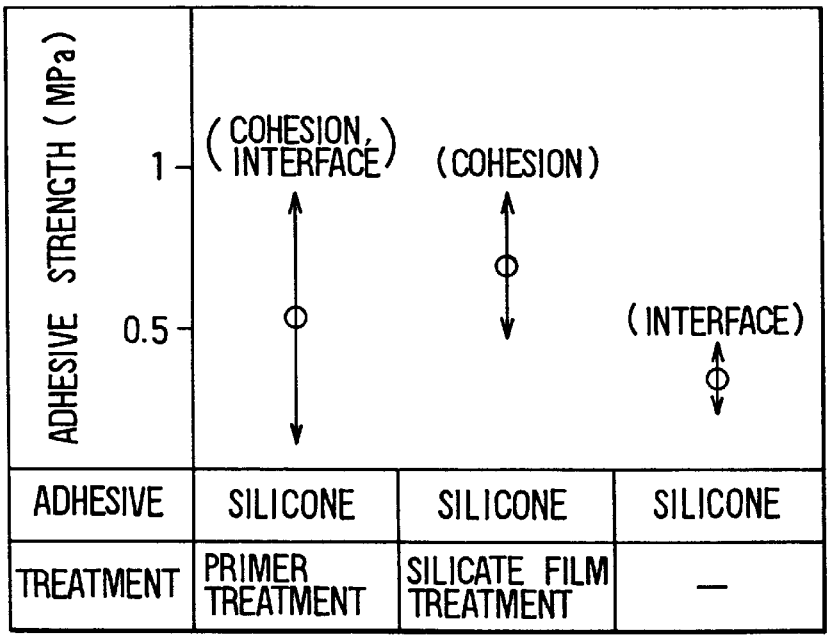
FIG. 7 is a chart showing adhesive strengths of the adhesives when the wettability improving film is provided and is not provided.

The results are shown in FIG. 7. In FIG. 7, a vertical axis indicates the adhesive strengths. As shown in the figure, the two samples having the organic film formed by the primer treatment and the silicate system film as the wettability improved films mainly underwent cohesive separation, while the sample without having the wettability improvement film underwent interface separation. This means that the samples having the wettability improvement films exhibit adhesive strengths larger than that of the sample without having the wettability improvement film. Further, the sample having the organic film has the larger variation and the lower stability than those of the sample having the silicate system film.

The reason is considered as follows. That is, at the primer treatment, silane coupling agent diluted with organic solution is coated on the surface of the tube and the like, and accordingly, the organic film having the adhesiveness to the silicone adhesive 5 is formed on the surface through a reaction between moisture contained in atmosphere and the silane coupling agent described above. This primer treatment is further accompanied by volatilization of the solution, hydrolysis of primer components, and the like, and therefore requires a period of time in a range of approximately 5 to 10 minutes for forming the organic film. As a result, the organic film easily has large variation in thickness due to the film formation mechanism described above. The large thickness of the organic film can result in breakage and interface separation of the organic film.

To the contrary, when the silicate system film is formed, as described in the above present embodiment, the film can be formed in an extremely short period of time (approximately 10 sec.). Therefore, the thickness of the wettability improvement film 6 is suppressed at an extremely thin range of approximately 200 Å to 500 Å. As a result, the film can be stably formed with desirable characteristics described above.

While the present invention has been shown and described with reference to the foregoing preferred embodiments, it will be apparent to those skilled in the art that changes in form and detail may be made therein without departing from the scope of the invention as defined in the appended claims.

For instance, the region where the adhesive 5 is to be applied is entirely covered with the wettability improvement film 6 in the present embodiment; however, it is not always required. For instance, only the outer surfaces of the tubes 3 where the wettability of the adhesive 5 becomes easily small may be covered with the wettability improving film 6. To the contrary, the tubes 3 and the core plates 4 may be covered with the wettability improving film 6 at a wider region including the region where the adhesive 5 is applied due to a reason for a manufacturing process. The method of mechanically joining the tubes 3 to the core plates 4 is not limited to the method described above, and may be performed by caulking or the like.

The silicate system film as the wettability improving film may be made of sodium silicate, magnesium silicate, calcium silicate, potassium silicate, or the like. Otherwise, the wettability improving film may be made of phosphate system film such as zinc phosphate, titanium phosphate, or zirconium phosphate. The phosphate system film can exhibit the same effects as that of the silicate system film. Although the tubes and the core plates 4 are made of aluminum alloy in the present embodiment, they may be made of aluminum.

The adhesive may be made of high polymer material to have a low elastic modulus and good thermal cycle characteristics. Further, the adhesive may be made of silicone system adhesive described above or denatured material thereof. In this case, cracks of the adhesive can be prevented from being produced by thermal cycles and the like, resulting in improved durability. Employed as the silicon system adhesive is, for instance, additive type or condensed type silicone such as dimethyl silicone, methyl phenyl silicone, or phenyl silicone. Employed as the denatured material of the silicone system adhesive is, for instance, fluorine denatured silicone, epoxy denatured silicone, or the like.

In the embodiment described above, the wettability improving film 6 is formed after the tubes 3 and the core plates 4 are joined to each other. In this case, the wettability improving film 6 can be formed on the tubes 3 and the core plates 4 at the same time, resulting in simplified manufacturing process. However, it may be formed before the tubes 3 and the core plates 4 are joined to each other. The wettability improving film is formed by applying the solution like shower onto the specific surfaces of the tubes 3 and the core plates 4; however the specific surfaces of the tubes 3 and the core plates 4 may be dipped into the solution to have the wettability improving film thereon.

What is claimed is:

1. A heat exchanger comprising:

a tank for accommodating a heat medium therein;

a core plate fixed to the tank and having a connection hole; and a tube coupled with a radiation fin, and having an end portion fixedly inserted into the connection hole of the core plate, wherein:

the tube and the core plate are made of one of aluminum and aluminum alloy, and are mechanically joined to each other at a joined portion thereof; and an adhesive is disposed on a specific region of the joined portion of the tube and the core plate through a wettability improving film interposed therebetween for improving a wettability of the adhesive to the specific region, to maintain a sealing property between the tube and the core plate; wherein:

the adhesive is made of one selected from a group consisting of a silicone system material and a denatured material of the silicone system material;

the wettability improving film is a silicate system film; and a thickness of the wettability improving film is approximately 200A–500A.

2. The heat exchanger of claim 1, wherein the adhesive is made of a high polymer material.

3. The heat exchanger of claim 1, wherein the heat exchanger is an automotive radiator.

4. The heat exchanger of claim 1, wherein the specific region is an outer surface of the tube in close proximity to the joined portion.

5. A method of manufacturing a heat exchanger having a tank for accommodating a heat medium therein and a tube connected to the tank through a core plate, the method comprising steps of:

inserting an end portion of the tube into a connection hole provided in the core plate, the tube and the core plate being made of one of aluminum and aluminum alloy;

mechanically joining the end portion of the tube to the core plate with a specific region at a joined portion therebetween, the specific region being covered with a wettability improving film made of an inorganic compound; and forming an adhesive for improving a sealing property at the joined portion, on the specific region through the wettability improving film capable of improving a wettability of the adhesive to the specific region; wherein:

the adhesive is made of one selected from a group consisting of a silicone system material and a denatured material of the silicone system material;

the wettability improving film is a silicate system film; and a thickness of the wettability improving film is approximately 200A–500A.

6. The method of claim 5, further comprising a step of forming the wettability improving film before forming the adhesive, by jetting out a solution like a shower onto the specific region of the tube and the core plate joined to each other.

7. The method of claim 5, further comprising a step of forming the wettability improving film before forming the adhesive, by dipping the specific region of the tube and the core plate joined to each other into a solution containing a component for forming the wettability improving film.

8. The method of claim 5, wherein the wettability improving film is formed on the specific region after the end portion of the tube and the core plate are mechanically joined to each other.

9. The method of claim 5, wherein the heat exchanger is an automotive radiator.

10. The method of claim 5, wherein the specific region is an outer surface of the tube in close proximity to the joined portion between the tube and the core plate.

11. The method of claim 5, further comprising:

before forming the adhesive, forming the wettability improving film; and washing a surface of the wettability improving film.

12. The method of claim 11, wherein the surface of the wettability improving film is washed by water.

13. A method of manufacturing a heat exchanger having a tank for accommodating a heat medium therein and a tube connected to the tank through a core plate, the method comprising steps of:

inserting an end portion of the tube into a connection hole provided in the core plate, the tube and the core plate being made of one of aluminum and aluminum alloy;

mechanically joining the end portion of the tube to the core plate with a specific region at a joined portion therebetween;

covering said specific region with a wettability improving solution to produce a wettability improving film, the wettability improving film being a silicate system film having a thickness of approximately 200A–500A;

rinsing said wettability solution from said specific after a specified period of time; and forming an adhesive for improving a sealing property at the joined portion, on the specific region through the wettability improving film capable of improving a wettability of the adhesive to the specific region.

14. The heat exchanger according to claim 13, wherein said wettability improving solution is made of an inorganic compound.

15. The heat exchanger according to claim 13, wherein said specified period of time is less than one minute.

16. A heat exchanger comprising:

a tank for accommodating a heat medium therein;

a core plate fixed to the tank and having a connection hole; and a tube coupled with a radiation fin, and having an end portion fixedly inserted into the connection hole of the core plate, wherein:

the tube and the core plate are made of one of aluminum and aluminum alloy, and are mechanically joined to each other at a joined portion thereof; and an adhesive is disposed on a specific region of the joined portion of the tube and the core plate through a wettability improving film interposed therebetween for improving a wettability of the adhesive to the specific region, to maintain a sealing property between the tube and the core plate; wherein:

the adhesive is made of one selected from a group consisting of a silicone system material and a denatured material of the silicone system material; and the wettability improving film is a phosphate system film.

17. The heat exchanger of claim 16, wherein the adhesive is made of a high polymer material.

18. The heat exchanger of claim 16, wherein the adhesive is made of one selected from a group consisting of a silicone system material and a denatured material of the silicone system material.

19. The heat exchanger of claim 16, wherein the heat exchanger is an automotive radiator.

20. The heat exchanger of claim 16, wherein a thickness of the wettability improving film is less than 500A.

21. The heat exchanger of claim 16, wherein the specific region is an outer surface of the tube in close proximity to the joined portion.

* * * * *